US005878835A

United States Patent [19]

Gall

[11] Patent Number: 5,878,835

[45] Date of Patent: Mar. 9, 1999

[54] WINDOW SCAFFOLDING SYSTEM

[76] Inventor: Steve A. Gall, 1625 Park Pl., Apt. 17, Brooklyn, N.Y. 11233

[21] Appl. No.: 19,585

[22] Filed: Feb. 6, 1998

[51] Int. Cl.[6] ..... E04G 3/06

[52] U.S. Cl. ..... 182/61; 182/55

[58] Field of Search ..... 182/61, 58, 59, 182/54, 55, 57, 60

[56] References Cited

U.S. PATENT DOCUMENTS

| | | | |
|---|---|---|---|
| 280,803 | 7/1883 | Dearborn . | |
| 1,239,472 | 9/1917 | Florian . | |
| 1,325,229 | 12/1919 | Braund . | |
| 1,478,100 | 3/1923 | Hughmiller . | |
| 1,912,319 | 5/1933 | Suejda . | |
| 2,194,978 | 3/1940 | Irgland . | |
| 2,849,251 | 8/1958 | Woyton . | |
| 4,428,457 | 1/1984 | Fikkers | 182/55 |

FOREIGN PATENT DOCUMENTS

| | | | |
|---|---|---|---|
| 1 348 994 | 12/1963 | France | 182/55 |
| 349064 | 11/1960 | Sweden | 182/58 |

*Primary Examiner*—Alvin Chin-Shue

[57] ABSTRACT

A window scaffolding system including a pair of main support frames. The pair of main support frames are oriented in a side by side relationship for supporting planks of wood on upper and lower ends thereof. A pair of L-shaped window engagement members couple with the pair of main supports for securement to a window opening. A supplemental safety bar is provided having a generally elongated and planar configuration. The safety bar has a pair of pads disposed on opposing ends thereof and a central pad disposed on a central portion thereof. A bolt extends through the central portion and the central pad for securement to the window engagement members to preclude the system from disengaging the window opening.

4 Claims, 3 Drawing Sheets

10
40
38
14
30
28
12
14
24

WINDOW SCAFFOLDING SYSTEM

BACKGROUND OF THE INVENTION

1. Field of the Invention

The present invention relates to a window scaffolding system and more particularly pertains to securing to a window opening for supporting a worker thereon with a window scaffolding system.

2. Description of the Prior Art

The use of scaffoldings is known in the prior art. More specifically, scaffoldings heretofore devised and utilized for the purpose of supporting workers thereon are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 4,475,626 to Gleich; 4,428,457 to Fikkers; U.S. Pat. No. Des. 315,796 to Smith et al.; U.S. Pat. Nos. 4,137,996 to Brown; 5,203,426 to Sydnor; and 4,320,816 to Callahan et al.

While these devices fulfill their respective, particular objective and requirements, the aforementioned patents do not describe a window scaffolding system for securing to a window opening for supporting a worker thereon.

In this respect, the window scaffolding system according to the present invention substantially departs from the conventional concepts and designs of the prior art, and in doing so provides an apparatus primarily developed for the purpose of securing to a window opening for supporting a worker thereon.

Therefore, it can be appreciated that there exists a continuing need for new and improved window scaffolding system which can be used for securing to a window opening for supporting a worker thereon. In this regard, the present invention substantially fulfills this need.

SUMMARY OF THE INVENTION

In the view of the foregoing disadvantages inherent in the known types of scaffoldings now present in the prior art, the present invention provides an improved window scaffolding system. As such, the general purpose of the present invention, which will be described subsequently in greater detail, is to provide a new and improved window scaffolding system and method which has all the advantages of the prior art and none of the disadvantages.

To attain this, the present invention essentially comprises a pair of main support frames. The pair of main support frames are oriented in a side by side relationship for supporting planks of wood on upper and lower ends thereof. Each of the support frames has an upper horizontal tube. The upper horizontal tube has an open upturned exterior end. Each of the support frames has a lower horizontal tube. The lower horizontal tube has an open upturned exterior end. The lower horizontal tube has an interior end with a stabilizing bar secured thereto in an orthogonal relationship thereto and on a same plane therewith. Each of the support frames has a criss-crossing intermediate frame member secured between the upper and lower horizontal frames thereof. A pair of L-shaped window engagement members couple with the pair of main supports for securement to a window opening. The window engagement members have an upper receiving tube dimensioned for slidably receiving interior ends of the upper horizontal tubes. The upper receiving tube has a lower tube extending downwardly from a free end thereof. The upper receiving tube and the lower tube each have a pad secured to interior surfaces thereof. Four safety poles are provided with each having lower ends slidably received within the open upturned exterior ends of the upper and lower horizontal tubes. The safety poles each have an eyelet disposed on upper ends thereof. A supplemental safety bar is provided having a generally elongated and planar configuration. The safety bar has a pair of pads disposed on opposing ends thereof and a central pad disposed on a central portion thereof. A bolt extends through the central portion and the central pad for securement to the window engagement members to preclude the system from disengaging the window opening.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window scaffolding system which has all the advantages of the prior art scaffoldings and none of the disadvantages.

It is another object of the present invention to provide a new and improved window scaffolding system which may be easily and efficiently manufactured and marketed.

It is a further object of the present invention to provide a new and improved window scaffolding system which is of durable and reliable construction.

An even further object of the present invention is to provide a new and improved window scaffolding system which is susceptible of a low cost of manufacture with regard to both materials and labor, and which accordingly is then susceptible of low prices of sale to the consuming public, thereby making such a window scaffolding system economically available to the buying public.

Even still another object of the present invention is to provide a new and improved window scaffolding system for securing to a window opening for supporting a worker thereon.

Lastly, it is an object of the present invention to provide a new and improved window scaffolding system including a pair of main support frames. The pair of main support frames are oriented in a side by side relationship for supporting planks of wood on upper and lower ends thereof. A pair of L-shaped window engagement members couple with the pair of main supports for securement to a window opening.

A supplemental safety bar is provided having a generally elongated and planar configuration. The safety bar has a pair of pads disposed on opposing ends thereof and a central pad disposed on a central portion thereof. A bolt extends through the central portion and the central pad for securement to the window engagement members to preclude the system from disengaging the window opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
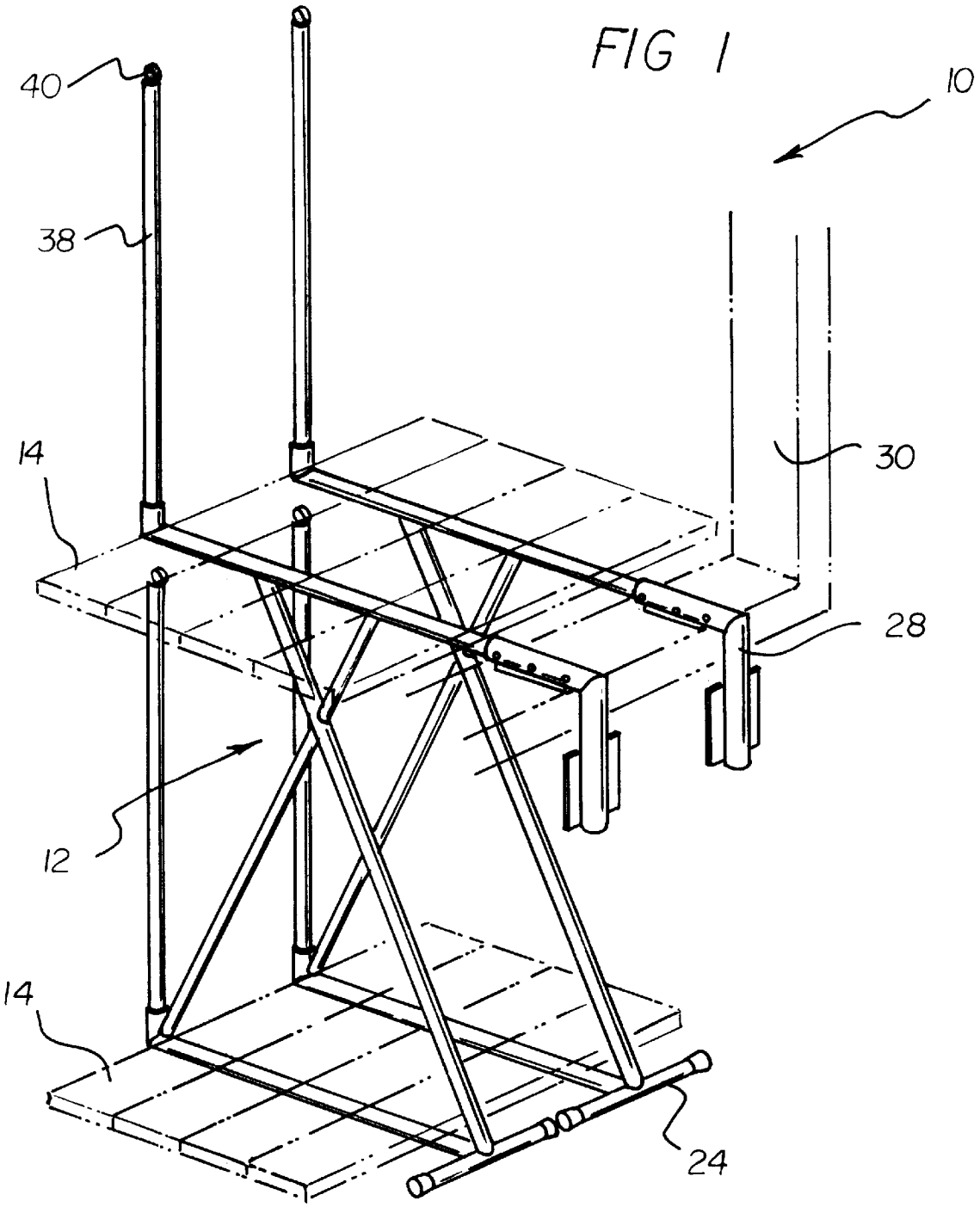
FIG. 1 is a perspective view of the preferred embodiment of the window scaffolding system constructed in accordance with the principles of the present invention.
Figure 2:
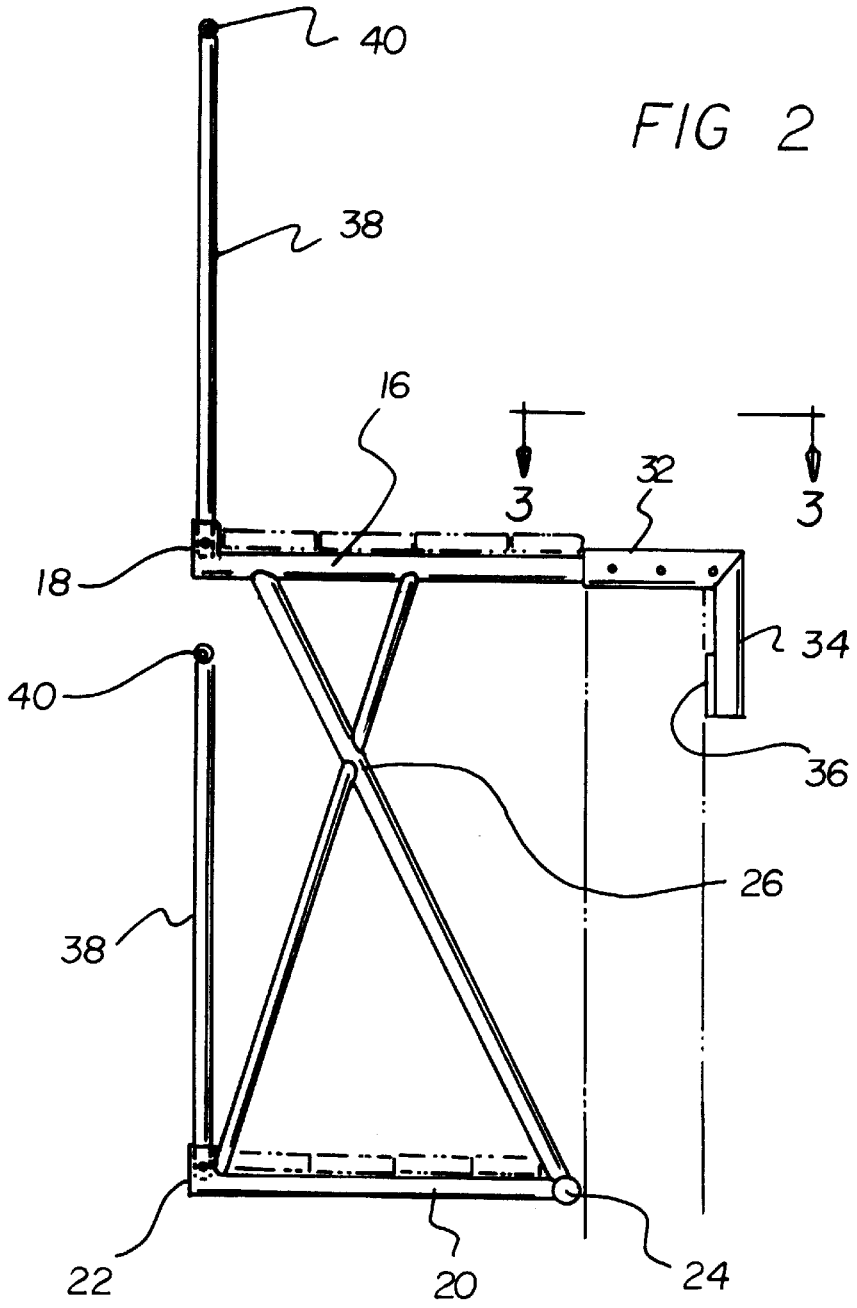
FIG. 2 is a side elevation view of the present invention.
Figure 3:
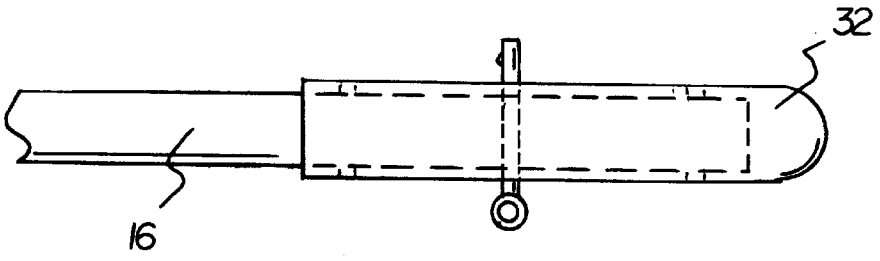
FIG. 3 is plan view of the L-shaped collar of the present invention as taken along line 3—3 of FIG. 2.
Figure 4:
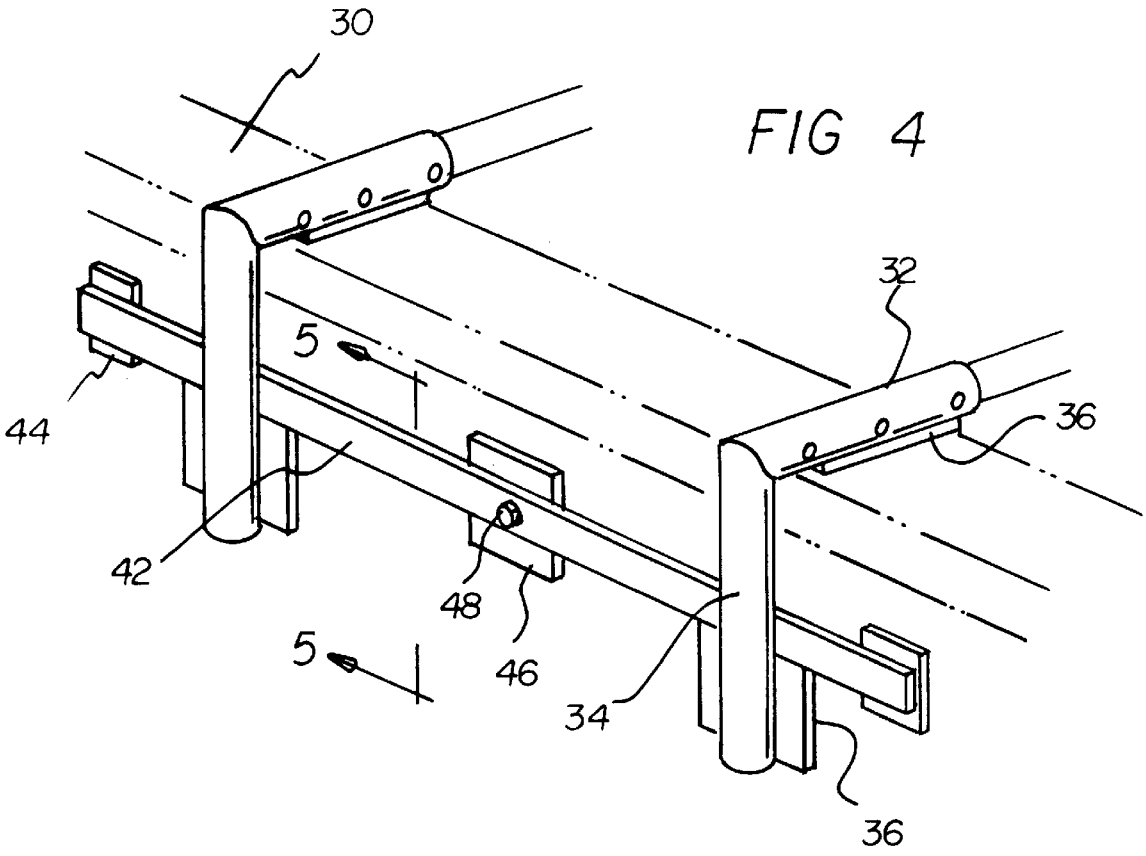
FIG. 4 is a partial perspective view illustrating use of the safety bar of the present invention.
Figure 5:
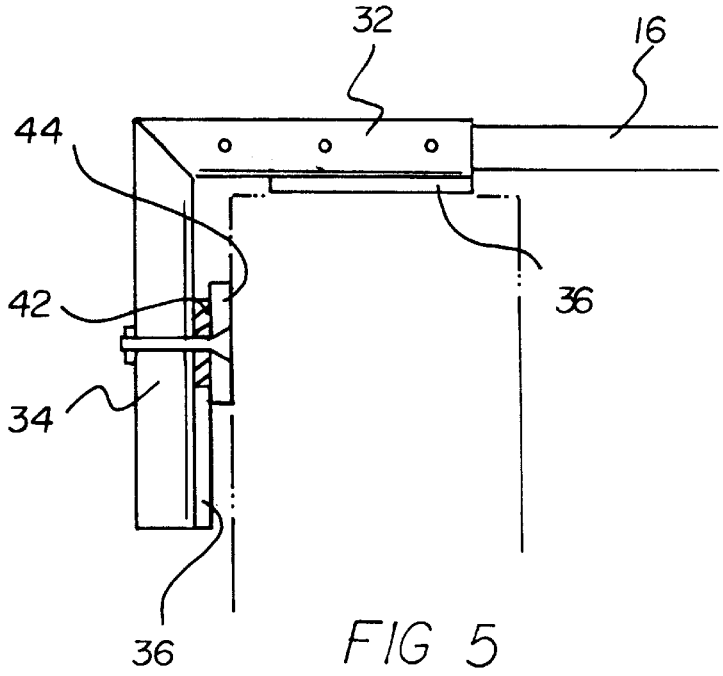
FIG. 5 is a cross-sectional view as taken along line 5—5 of FIG. 4.

With reference now to the drawings, and in particular, to FIGS. 1 through 5 thereof, the preferred embodiment of the new and improved window scaffolding system embodying the principles and concepts of the present invention and generally designated by the reference number 10 will be described.

Specifically, it will be noted in the various Figures that the device relates to a window scaffolding system for securing to a window opening for supporting a worker thereon. In its broadest context, the device consists of a pair of main support frames, a pair of L-shaped window engagement members, four safety poles and a supplemental safety bar. Such components are individually configured and correlated with respect to each other so as to attain the desired objective.

The pair of main support frames 12 are oriented in a side by side relationship for supporting planks of wood 14 on upper and lower ends thereof. Note FIG. 1. Each of the support frames 12 has an upper horizontal tube 16. The upper horizontal tube 16 has an open upturned exterior end 18. Each of the support frames 12 has a lower horizontal tube 20. The lower horizontal tube 20 has an open upturned exterior end 22. The lower horizontal tube 20 has an interior end with a stabilizing bar 24 secured thereto in an orthogonal relationship thereto and on a same plane therewith. The stabilizing bar 24 will abut a side of house or the like below a window when the system 10 is in use. Each of the support frames 12 has a criss-crossing intermediate frame member 26 secured between the upper and lower horizontal tubes 16,20 thereof.

The pair of L-shaped window engagement members 28 couple with the pair of main supports 12 for securement to a window opening 30. The window engagement members 28 have an upper receiving tube 32 dimensioned for slidably receiving interior ends of the upper horizontal tubes 16. The upper receiving tube 32 can be adjusted with respect to the upper horizontal tubes 16 to accommodate a thickness of the wall of the window opening 30. The upper receiving tube 32 has a lower tube 34 extending downwardly from a free end thereof. The upper receiving tube 32 and the lower tube 34 each have a pad 36 secured to interior surfaces thereof. The window engagement members 28 engage the window opening 30 so that the pair supports 12 can hang outside of the window. Note FIG. 2. The pads 36 will prevent any damage from occurring to the window or its frame when the system 10 is in use.

The four safety poles 38 each have lower ends slidably received within the open upturned exterior ends 18,22 of the upper and lower horizontal tubes 16,20. The safety poles 38 each have an eyelet 40 disposed on upper ends thereof. The eyelets 40 allows for rope to be extended between the poles 38 to prevent a person from inadvertently backing off of the system 10.

The supplemental safety bar 42 has a generally elongated and planar configuration. The safety bar 42 has a pair of pads 44 disposed on opposing ends thereof and a central pad 46 disposed on a central portion thereof. A bolt 48 extends through the central portion and the central pad 46 for securement to the window engagement members 28 to preclude the system 10 from disengaging the window opening 30. While the present invention is shown to be used with a single window opening in FIG. 1, it should be noted that each of the window engagement members are preferably situated within a separate window opening. As long as an interior wall does not exist between the windows within the building, the safety bar may still be attached between the window engagement members thereby providing a full-proof means of precluding the window engagement members and safety bar from disengaging from the building.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A window scaffolding system for securing to a window opening for supporting a worker thereon comprising, in combination:

a pair of main support frames, the pair of separate main support frames being oriented in a side by side relationship for supporting planks of wood on upper and lower ends thereof, each of the support frames having an upper horizontal tube, the upper horizontal tube having an open upturned exterior end, each of the support frames having a lower horizontal tube, the lower horizontal tube having an open upturned exterior end, the lower horizontal tube having an interior end with a stabilizing bar secured thereto in an orthogonal relationship thereto and on a same plane therewith, each of the support frames having a criss-crossing intermediate frame member secured to and spacing the upper and lower horizontal tubes thereof, said intermediate frame being the only interconnection between the upper and lower horizontal tubes;

a pair of L-shaped window engagement members coupling with the pair of main supports for securement to a window opening, the window engagement members having an upper receiving tube dimensioned for slidably receiving interior ends of the upper horizontal tubes, the upper receiving tube having a lower tube extending downwardly from a free end thereof, the upper receiving tube and the lower tube each having a pad secured to interior surfaces thereof;

four safety poles each having lower ends slidably received within the open upturned exterior ends of the upper and lower horizontal tubes, the safety poles each having an eyelet disposed on upper free ends thereof; and a supplemental safety bar having a generally elongated and planar configuration, the safety bar having a pair of pads disposed on opposing ends thereof and a central pad disposed on a central portion thereof, a bolt extending through the central portion and the central pad for securing the central pad to the safety bar to preclude the system from disengaging the window opening.

2. A window scaffolding system for securing to a window opening for supporting a worker thereon comprising, in combination:

a pair of main support frames, the pair of separate main support frames being oriented in a side by side relationship for supporting planks of wood on upper and lower ends thereof;

a pair of L-shaped window engagement members coupling with the pair of main supports for securement to a window opening wherein each of the main support frames has an upper and lower horizontal tube, the lower horizontal tube having an interior end with a stabilizer bar secured thereto in an orthogonal relationship thereto and on a same plane therewith, each of the support frames having a crisscrossing intermediate frame member secured to and spacing the upper and lower horizontal tubes thereof, said intermediate frame being the only interconnection between the upper and lower horizontal tubes; further including four safety poles each with lower ends slidably received within upturned exterior ends of the upper and lower horizontal tubes, the safety poles each having an eyelet disposed on upper free ends thereof; and a supplemental safety bar having a generally elongated and planar configuration, the safety bar having a pair of pads disposed on opposing ends thereof and a central pad disposed on a central portion thereof, a bolt extending through the central portion and the central pad for securing the central pad to the safety bar to preclude the system from disengaging the window opening.

3. The window scaffolding system as set forth in claim 2 wherein the window engagement members have an upper receiving tube dimensioned for slidably receiving interior ends of the upper horizontal tubes, the upper receiving tube having a lower tube extending downwardly from a free end thereof.

4. The window scaffolding system as set forth in claim 3 wherein the upper receiving tube and the lower tube each having a pad secured to interior surfaces thereof.

* * * * *